United States Patent [19]

Schleicher

[11] Patent Number: 4,797,305

[45] Date of Patent: Jan. 10, 1989

[54] PROCESS AND APPARATUS FOR PAINTING GOLF HOLES

[76] Inventor: John Schleicher, 46 Sperry Rd., Bethany, Conn. 06525

[21] Appl. No.: 125,885

[22] Filed: Nov. 27, 1987

[51] Int. Cl.[4] ..... B05D 1/02; B05D 7/22

[52] U.S. Cl. ..... 427/236; 118/306; 118/317; 118/323; 118/301; 239/274; 239/288; 222/635

[58] Field of Search ..... 118/306, 317, 323, 301; 401/137, 193, 190, 9; 222/635; 239/288.4, 274; 427/236, 421

[56] References Cited

U.S. PATENT DOCUMENTS

| | | | |
|---|---|---|---|
| 2,343,842 | 3/1944 | Hatcher | 118/317 X |
| 2,800,874 | 7/1957 | Leslie | 118/301 |
| 3,149,761 | 9/1964 | Harris et al. | 239/154 |
| 3,572,591 | 3/1971 | Brown | 401/190 |
| 3,716,195 | 2/1973 | Silva | 239/375 |
| 3,841,532 | 10/1974 | Gores | 401/190 |
| 3,850,656 | 11/1974 | Brown | 401/190 |
| 3,979,163 | 9/1976 | Beard | 401/190 |
| 4,043,295 | 8/1977 | Speck et al. | 118/317 |
| 4,485,971 | 12/1984 | Pajevic | 239/375 |

*Primary Examiner*—Shrive Beck
*Attorney, Agent, or Firm*—Bachman & LaPointe

[57] ABSTRACT

The present invention relates to a process and apparatus for painting golf holes. The apparatus comprises a substantially planar disk base member having a central opening and an integral skirt to be placed over the hole to prevent the inadvertent application of paint to the grass surrounding the hole. The apparatus further comprises a receptacle attached to the base for receiving and positioning a can of spray paint so that the paint discharge opening lies at a desired position within the confines of the hole. To paint a hole, a can of spray paint is placed in an inverted position, inserted into the receptacle until a push button for initiating a spray of paint is depressed against a stop and rotated one full turn.

11 Claims, 1 Drawing Sheet

PROCESS AND APPARATUS FOR PAINTING GOLF HOLES

BACKGROUND OF THE INVENTION

The present invention relates to the maintenance of the playing holes on a golf course in general, and to a device for applying a white coating to the walls of golf holes in particular.

The holes on most golf course are repainted quite infrequently, if at all, but are customarily painted for special events such as forthcoming tournaments. Currently, they are painted by an attendant such as a greenskeeper using a hand brush. This technique requires some dexterity and considerable bending on the part of the attendant. In addition, it requires a great deal of time which makes the task rather costly. A technique which reduces the dexterity and bending required of the attendant as well as the time involved clearly would be welcome.

Spray cans of paint as well as devices for facilitating their use in awkward and unusual modes have been known for quite some time. U.S. Pat. No. 3,149,761 for example illustrates a device for actuating the valve of a pressurized container such as a spray paint can. The device allows material to be sprayed while the cntainer is in an inverted position and at arm's length. U.S. Pat. No. 3,716,195 to Silva illustrates another device for allowing paint to be sprayed from a container at arm's length. The Silva extension hand sprayer device is described as having utility in spraying a line on pavement while the user stands in an erect position.

Devices for applying a coating material to the interior of a workpiece are also known. U.S. Pat. No. 4,043,295 to Speck et al. illustrates a method and apparatus for applying a coating material to the internal threads of pipes or fittings. U.S. Pat. No. 2,343,842 to Hatcher illustrates a device for coating the interior of an ingot mold.

There is one requirement related to golf which renders most of these devices, if not all, unsuitable for painting golf holes. This requirement is that the grass surrounding the hole must not be painted.

Accordingly, it is an object of the present invention to provide a process and apparatus for painting a golf hole which does not paint the grass surrounding the hole.

It is a further object of the present invention to provide a process and apparatus as above which provides an aesthetically pleasing, substantially uniform coating unmarred by brush marks or streaks from the earthen background in the hole.

It is yet a further object of the present invention to provide a process and apparatus as above which is relatively simple to use.

It is still a further object of the present invention to provide a process and apparatus as above which reduces the amount of time required to paint each golf hole.

These and other objects and advantages will become more apparent from the following description and drawings wherein like references numerals depict like elements.

SUMMARY OF THE INVENTION

The present invention relates to an apparatus for positioning a pressurized paint container having a valve assembly including a push button for operating a valve and an opening for discharging the contents of the container in a desired relationship with respect to a surface of an object such as a golf hole to be painted. While the paint can positioning apparatus of the present invention may be used with any pressurized paint container, it is preferred to use it with a container having a discharge opening in the form of an axial slit for generating a fan-like spray of paint.

The paint can positioning apparatus of the present invention has a base, preferably in the form of a substantially planar disk with a central opening, and a receptacle attached to the base for receiving and holding the paint container in a desired position, i.e., an inverted position with part of the receptacle forming a means for actuating the container's valve assembly to discharge the contents of the container. The receptacle is preferably formed by a central member and a plurality of radial arms spaced substantially equidistant about the periphery of the opening in the base. Each radial arm has a first angled portion for guiding the container into the desired position and for supporting it during use and a second angled portion acting as a guide and a stop for the push button on the paint container. Each arm further includes a third portion to assist in positioning the container and a substantially L-shaped portion joining the first and second angled portions. An adjustment screw is provided for positioning the push button in a desired location within the receptacle and for actuating the valve assembly so as to obtain a spray of white paint where desired. A skirt is also provided about the periphery of the base to prevent paint from being applied to unwanted locations.

Spray painting of the golf hole is accomplished by positioning the base over the hole so that the skirt is brought into registration with the top of the hole and the receptacle extends into the hole, inverting the paint can, inserting it into the receptacle, pressing the push button on the spray can against the valve actuating means, and rotating the can. To facilitate rotation of the can, a surface of the push button is provided with an indentation in the form of a substantially conically shaped notch adapted to receive a similarly shaped element defining a pivot point. In a preferred embodiment, the pivot point comprises a substantially conically shaped tip portion on the adjustment screw.

As can be seen from the foregoing description, the present invention secures the advantages of brushless painting in the application of the paint coating, i.e., uniform thickness and a coating appearance unmarred by brush marks or streaks from the earthen background in the hole. In addition, the use of the present invention requires hardly any dexterity on the part of an attendant and can be done quite rapidly at each hole so that the relative low cost involved permits periodic paintiing of the golf holes.

DETAILED DESCRIPTION

Figure 2:
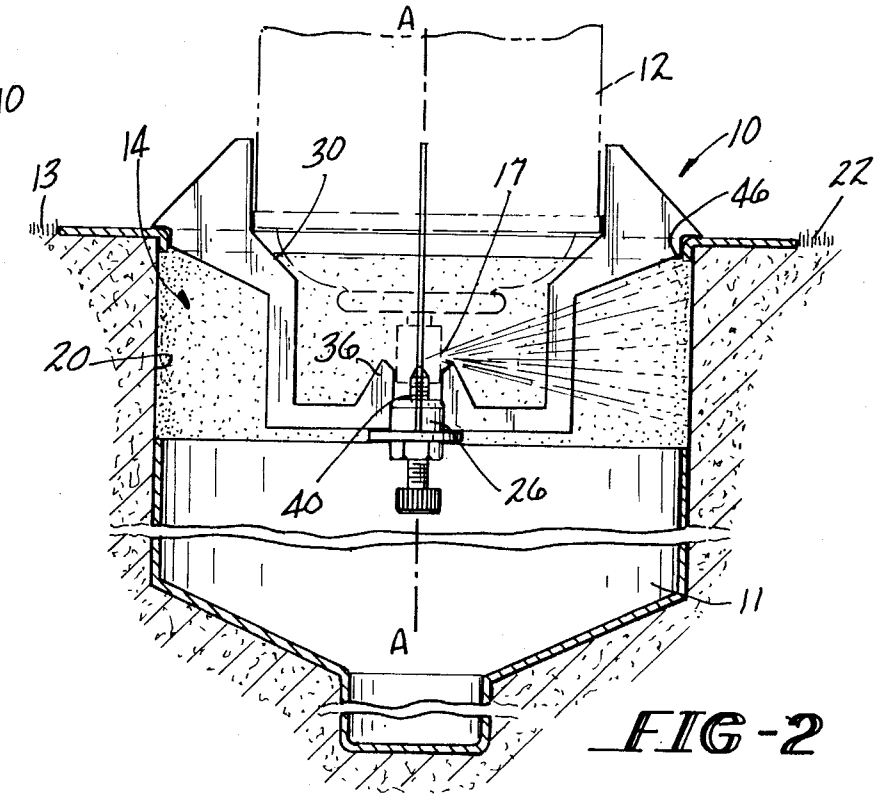
FIG. 2 is a perspective view of the holder positioned within a golf hole to be painted.
Figure 4:
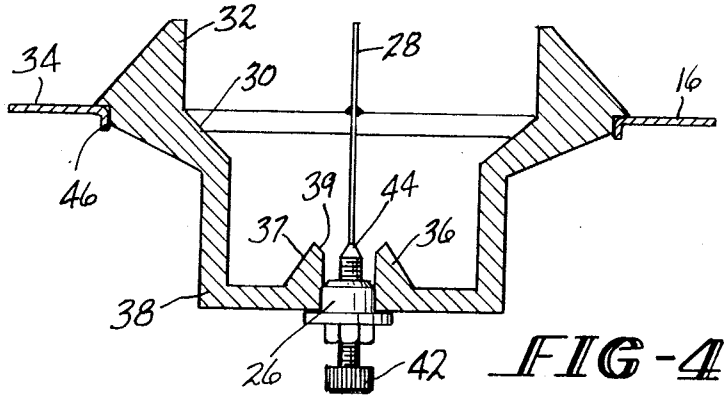
FIG. 4 is a cross sectional view of the holder of FIG. 1.
Figure 1:
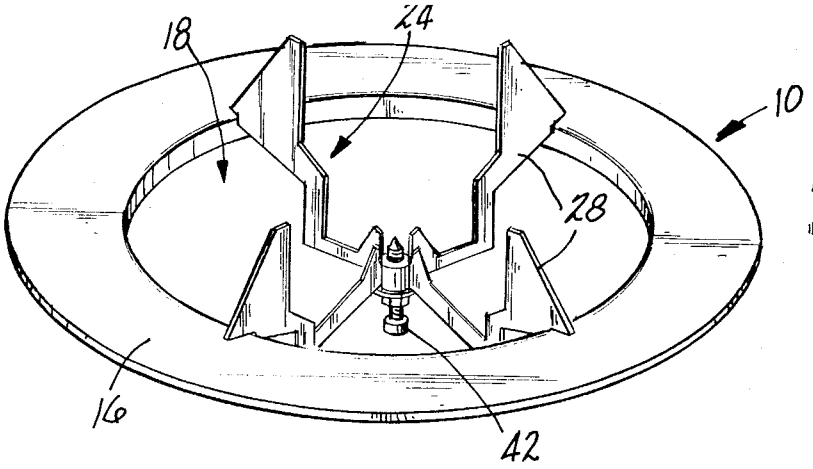
FIG. 1 is a perspective view of the paint can holder of the present invention.
Figure 3:
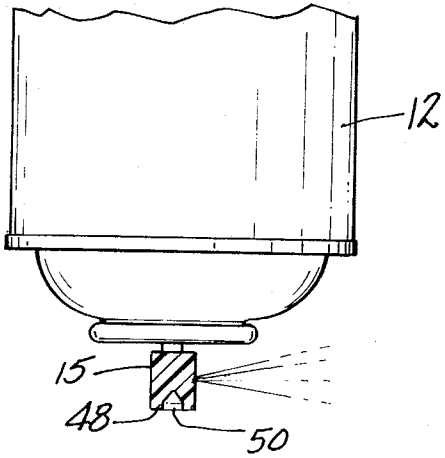
FIG. 3 is a top view of a special paint can to be used with the holder of the present invention.

Referring now to the drawings, an apparatus 10 is illustrated in FIG. 1 for positioning a paint can 12 within a hole 14 in a golf green 22 to paint a portion of the hole between the upper periphery of a cup 11 for receiving a golf ball and the surface 13 of the green. The apparatus 10 may be used with any spray paint can 12 having a valve assembly (not shown), a push button 15 for actuating the valve assembly and an opening 17 through which paint can be discharged.

The apparatus 10 comprises a base 16 preferably in the form of a substantially planar disk having a central opening 18 and a central axis A substantially parallel to the walls 20 of the hole 14. The opening 18 defined by the inner periphery of the disk 16 preferably has a diameter slightly less than the diameter of the golf hole. The disk 16 forming the base may have any desired outer diameter. Generally, the outer diameter of the disk should be large enough to cover a portion of the golf green 22 adjacent the hole.

Attached to the base 16 is a receptacle 24 for receiving and holding the paint can 12 in a desired position. The receptacle 24 is formed by a central member 26 and a plurality of inwardly directed radial arms 28 joined to the central member 26 and the base 16. The arms 28 may be joined to the base 16 and the member 26 in any suitable manner such as by welding.

The radial arms 28 preferably are spaced substantially equidistant about the periphery of the opening 18 and are sufficiently thin that they do not interfere with the painting of the hole 14. While any number of radial arms may be provided, it is preferred to have at least three, ideally four such arms.

Each arm is configured so as to have a first angled portion 30 for assisting in guiding a paint can 12 into the desired position and for supporting the can during painting. A portion 32 of each arm extends above the upper surface 34 of the base 16 in a direction substantially parallel to the axis A. During use, the portions 32 assist in maintaining the can 12 in the desired position. Preferably, the arm portions 32 are dimensioned so that their inner edges define a circle having a diameter slightly larger than the outer diameter of the paint can 12.

Each arm 28 further includes a second angled portion 36 formed by surfaces 37 and 39. This portion of each arm serves as a guide and a stop for the push button 15. Still further, each arm 28 has an L-shaped portion 38 joining said first and second angled portions.

The central member 26 has a threaded bore 40 for receiving a threaded adjustment screw 42 for setting the position of the push button 15 and the discharge opening 17 at a desired location relative to the walls to be painted and for depressing the push button 15 to actuate the valve assembly to initiate the flow of paint through the opening 17. The bore 40 and the screw 42 are each preferably centered along the axis A. For reasons to be explained in more detail hereinafter, the screw 42 has a substantially conically shaped tip portion 44.

A skirt 46 is provided about the inner periphery of the base 16 to further prevent the inadvertent application of paint to the surface of the green. The skirt 46 is preferably formed by an integral down turned edge portion of the base.

After a can 12 has been placed in the apparatus 10, the painting operation typically requires the attendant to manually turn the can 12 for at least one full turn while keeping the push button 15 depressed against the screw 42. To facilitate rotation of the can and the spray issuing therefrom, the top surface 48 of the push bottom is provided with an indentation 50 for receiving the tip 44 of the adjustment screw 42. Preferably, the indentation 50 has a configuration identical to the shape of the tip 44, namely a substantially conical shape.

In a preferred construction for the spray paint can 12, the push button 15 is provided with a discharge opening 17 in the form of an axial slit. It has been found that the paint spray issuing from such an opening is substantially fan-shaped. Such a spray from the can is advantageous in that the paint applied to the wall of a hole is distributed fairly evenly over the entire width of the coating on a single application. This makes for a saving of paint as well as a substantially uniform appearance to the coating. Additionally, the coating is devoid of any brush marks yet so evenly distributed as though applied with a brush.

To use the apparatus of the present invention, the apparatus 10 is placed over the hole 14 so the skirt 46 is brought into register with the top portion of the hole 14 and the base 16 covers a portion of the grass surrounding the hole. A can 12 of white spray paint is then manually placed in an inverted position and inserted into the receptacle 24 until the push button portion 15 of the can abuts the stop formed by the tip 44 of the screw 42. When the button 15 abuts the stop, the discharge opening 17 for emitting the spray of paint lies within the confines of the hole to be painted. Thereafter, the can is further depressed against the screw 42 to push the button 15 to actuate the valve assembly and to initiate the flow of paint through the opening 17. At the same time, the can is rotated manually to apply the desired paint coating to the walls of the hole. As previously discussed, the skirt 46 and the base 16 prevent the application of paint to the grass surrounding the hole. It has been found that only one full turn of the can is needed to apply the desired coating.

As can be seen from the foregoing discussion, the present invention is relatively simple to use and requires less dexterity on the part of the user. Further, it is economically sound in that less paint is used to obtain the desired coatings and less time is required to apply the coatings.

While the various components of the apparatus 10 may be formed from any suitable metallic or non-metallic material, it is preferred to form them from a metal such as cold rolled steel which has been plated to prevent attack by chemicals used to maintain the golf course. If desired, the apparatus could be formed from appropriately treated aluminum or an aluminum alloy.

While the apparatus 10 has particular utility in painting golf holes, it may also be used to paint the walls or surfaces of other annularly shaped objects.

It is apparent that there has been provided in accordance with this invention a process and apparatus for painting golf holes which fully satisfy the objects, means, and advantages set forth hereinbefore. While the invention has been descirbed in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An apparatus for positioning a pressurized paint container having a valve assembly including a push button and an opening for discharging the contents of said container in a desired relationship with respect to an inside surface of an annularly shaped object to be painted which comprises:

a base having a central opening with a central axis substantially parallel to said surface to be painted, said base being adapted to be positioned over said object to be painted; and receptacle means attached to said base for receiving and holding said container in a position permitting said opening to discharge the contents of said container in a direction substantially perpendicular to both said central axis and said surface to be painted; said receptacle means including means for actuating said valve assembly to discharge said contents.

2. An apparatus for positioning a pressurized paint container having a valve assembly including a push button and an opening discharging the contents of said container in a desired relationship with respect to an inside surface of an annularly shaped object to be painted which comprises:

a base having a central opening with a central axis, said base being adapted to be positioned over said object to be painted;

receptacle means attached to said base for receiving and holding said container in a desired position;

said receptacle means including means for actuating said valve assembly to discharge said contents;

said receptacle means further including a central member and a plurality of substantially equi-spaced inwardly directed radial arms; and each said arm being joined to said central member and said base and being sufficiently thin so as not to interfere with the application of paint to said surface.

3. An apparatus according to claim 2 wherein each said arm has a first angled portion for guiding said container into said desired position and for supporting said container during use and a second angled portion for guiding said push button into a desired position.

4. An apparatus according to claim 3 wherein each said arm further has a third portion extending substantially parallel to said central axis for assisting in positioning said container and a substantially L-shaped portion joining said first and second angled portions.

5. An apparatus according to claim 3 which further comprises means for setting the position of said valve button and said discharge opening along said central axis so as to obtain a spray of paint in a desired location, and wherein said setting means also forms said valve assembly actuating means.

6. An apparatus according to claim 5 wherein said central member has a threaded bore and said setting means comprises an adjustment screw threadably received within said bore for contacting a surface of said valve button.

7. An apparatus according to claim 6 wherein said adjustment screw has a substantially conical tip and said valve button surface has an indentation for receiving said tip whereby said tip and said indentation form a pivot about which said container can be rotated.

8. An apparatus according to claim 3 which further comprises a skirt assembly integrally joined to said base, said skirt preventing the application of paint to unwanted locations.

9. An apparatus according to claim 3 wherein said base comprises a substantially planar disk having an opening and said receptacle means has four of said arms equi-spaced about the periphery of the opening in said disk.

10. An apparatus according to claim 8 wherein:

said annularly shaped object comprises a hole within a golf green and said surface to be painted comprises the walls of said hole;

said base is positioned over said hole so that a portion of said base covers a portion of the green adjacent the hole and said skirt covers an upper portion of the walls so as to prevent paint from being sprayed onto said green; and said arms hold said container in an inverted position so that said discharge opening lies within the confines of said hole.

11. A process for spray painting a golf hole which comprises:

providing a can of spray paint having a valve assembly, a push button for operating said valve assembly, and a discharge opening in said button;

positioning a holder for said can having means for actuating said valve assembly over said hole;

inverting said can and inserting said inverted can into said holder so that said discharge opening lies a desired distance below the upper periphery of said hole;

pressing said push button against said valve assembly actuating means to initiate the flow of paint through said opening; and rotating said can to paint the walls of said golf hole.

* * * * *